US007536969B2

(12) United States Patent
Kyle

(10) Patent No.: US 7,536,969 B2
(45) Date of Patent: May 26, 2009

(54) STAINLESS STEEL HATCH AND METHOD OF MANUFACTURE

(75) Inventor: James H. Kyle, Keene, NH (US)

(73) Assignee: Pompanette, LLC, Charlestown, NH (US)

( * ) Notice: Subject to any disclaimer, the term of this patent is extended or adjusted under 35 U.S.C. 154(b) by 0 days.

(21) Appl. No.: 11/906,211

(22) Filed: Oct. 1, 2007

(65) Prior Publication Data

US 2009/0084300 A1 Apr. 2, 2009

(51) Int. Cl.
*B63B 19/16* (2006.01)

(52) U.S. Cl. ..... 114/201 R

(58) Field of Classification Search ..... 114/201 R
See application file for complete search history.

(56) References Cited

U.S. PATENT DOCUMENTS 5,231,948 A * 8/1993 Malmanger et al. ..... 114/201 R
RE36,436 E * 12/1999 Kyle ..... 114/178
2001/0017095 A1* 8/2001 Shaddle ..... 105/377.07

* cited by examiner

*Primary Examiner*—Stephen Avila
(74) *Attorney, Agent, or Firm*—Simpson & Simpson, PLLC

(57) ABSTRACT

A base for a marine hatch including a planar exterior flange running in a plane substantially parallel with a boat hull or deck, an angular leg running generally transverse to the planar exterior flange, the angular leg terminating in a spigot, wherein the spigot is substantially perpendicular to the exterior planar flange, the spigot is operatively positioned so that the spigot runs substantially parallel to a neutral bending axis, and the neutral bending axis passes through or is directly proximate the spigot, and an elevated sealing bead for engaging with a hatch cover, the planar exterior flange and the angular leg being integral with the elevated sealing bead.

23 Claims, 3 Drawing Sheets

STAINLESS STEEL HATCH AND METHOD OF MANUFACTURE

FIELD OF THE INVENTION

The present invention relates to hatches, and more particularly, to improved marine hatches and methods of manufacturing the same.

BACKGROUND OF THE INVENTION

Hatches, particularly hatches for boats, are fairly well known devices that allow ingress and egress into and out of enclosed areas, e.g., boat cabins, and/or allow light to enter an enclosed area. Deck hatches are available in many sizes, from small ventilation hatches to larger hatches used as emergency exit points. A ventilation hatch might be as small as 12×12 inches, where as a typical large hatch intended for persons and objects to pass through might be 20×20 inches. Hatches, thus, generally comprise assemblies that allow entry, exiting and closure, generally comprise a cover, a base, hinge means connecting the cover and the base, and a gasket means between the cover and the base to ensure a water-tight seal. Hatches may be installed on boat hulls and decks. Standard production boats typically have decks fabricated of fiberglass. The outer surface is often mirror finished, while the underside of the deck is typically raw and unfinished.

Boat builders economically install a deck hatch by further including a trim ring. The trim ring is usually molded from thermo-formed plastic or formed by bending aluminum angle extrusions. The trim ring engages between a spigot on the hatch base which extends inside a cutout in the boat deck, for example, and the portion of the deck which comprises the edge of the deck opening for the hatch. The slip fit of the trim ring to the deck hatch is critical and highly visible. A spigot, or vertical flange, on both the trim ring and the hatch base are desirable to allow for overlap for enabling a slip fit. More importantly, the trim ring and hatch base must be able to variably overlap, as deck thicknesses vary. Typical spigot lengths are 1 inch to 1⅛ inches. The overlapping spigot on the trim ring can be varied to suit, from commonly ½ inch to 4 inches or more.

Heretofore, boat hatches, and more particularly, hatch bases were fabricated exclusively of aluminum or plastic, due to the shape to which they must conform. Since aluminum is not a very stiff/rigid metal, i.e. flexural properties, it can readily undergo the required bends to conform to the hatch shape without experiencing unacceptable deformation. Since hatches are highly visible components on boats, however, it is of the utmost importance that they do not appear warped, crooked, or otherwise misshaped.

In contradistinction to aluminum boat hatches, hatches fabricated from stainless steel have not been used in volume production boat building, and rarely in boat building at all, because of the rigid properties of stainless steel, and concomitant higher manufacturing costs. The rigid properties of stainless steel inhibit bending of the workpiece to the required radii without significant visual distortion to the frame caused by stress forces generated during the bending process. Often times, however, stainless steel would be preferable over aluminum or plastic because it will not readily rust, corrode, warp, or deform, once in place. Additionally, stainless steel does not require the usual protective coatings or treatments, as is the case with aluminum.

Stainless steel hatch bases may be fabricated, but they normally require considerably more time to manufacture and install, which translates into substantially higher costs. Heretofore, one method for fabricating stainless steel hatches has been by traditional bending methods. However, such earlier methods resulted in excessive visual distortion in the hatch base having a traditional cross-section, a spigot was not included as an integral part of the hatch base. Consequently, a trim ring could not be used because there was no spigot with which to engage. Instead, the boat builder would custom design, craft, and install a trim ring substitute, which drastically raised production time, and therefore, costs making them economically unattractive. Accordingly, stainless steel for use in marine hatches has not been considered an acceptable material for production boat building, and has been reserved primarily for use by specialty boat builders.

To date, there have been no stainless steel hatch bases available which included spigots. Historically, hatch bases are all similar to an angle shape, generally having horizontal flanges about 1¼ inches wide, and vertical spigots of 1 inch or more. This traditional shape, when made from thin walled stainless steel, results in too much flaring, or distortion, of the flange and/or spigot after bending to be acceptable for use in the marine industry. A distorted hatch frame is not aesthetically attractive and also results in an engagement with the trim ring which is not uniform or constant.

What is needed, then, is a stainless steel hatch which includes inter-alia a base design which is economically attractive for most commercial production boat building.

SUMMARY OF THE INVENTION

The present invention generally comprises a base for a marine hatch including a planar exterior flange running in a plane substantially parallel with a boat hull or deck, an angular leg running generally transverse to the planar exterior flange, the angular leg terminating in a spigot, wherein the spigot is substantially perpendicular to the exterior planar flange, the spigot is operatively positioned so that the spigot runs substantially parallel to a neutral bending axis, and the neutral bending axis passes through or is directly proximate the spigot, and an elevated sealing bead for engaging with a hatch cover, the planar exterior flange and the angular leg being integral with the elevated sealing bead.

In one embodiment the hatch base has a wall thickness which is substantially constant throughout. In preferred embodiments the exterior flange includes a plurality of apertures operatively arranged for receiving securing means, such as screws, for affixing the hatch frame to a deck or hull of a boat. In preferred embodiments the hatch base has a polygonal or circular shape.

The stainless steel base can be fabricated by a process including the steps of firstly forming a straight length of a stainless steel bar stock with a substantially constant cross-section by passing a stainless steel work piece through a plurality of roll-forming roller sets, wherein each roller set includes at least two oppositely disposed rollers which form a slot through which the work piece is rolled, wherein each slot is operatively arranged to longitudinally bend the work piece as the work piece passes through each roller set, wherein the work piece passes sequentially, in any order, through each roller set in the plurality of roller sets, wherein the plurality includes at least first, second, and third roller sets, wherein the first roller set bends a substantially hairpin bend into the work piece to form an elevated bead, the second roller set bends the work piece to form a planar exterior flange, the third roller set bends the work piece to form an angular leg terminating in a spigot, wherein the angular leg runs in a plane generally transverse to the planar exterior flange, and wherein the spigot runs in a plane substantially perpendicular to the planar exterior flange, secondly cutting the bar stock or work piece to a predetermined length based on a desired final size of the hatch base, thirdly bending a plurality of corners into the length of the work piece, wherein the corners are operatively bent into the work piece to substantially shape the work piece into a ring with opposite ends of the work piece proximate each other, and wherein the bending is operatively performed so that the spigot is substantially parallel to a neutral axis of the bending, and the neutral axis passes through or is directly proximate to the spigot, and lastly welding the opposite ends together so that work piece forms a hatch base that is continuous and integral.

In one embodiment, at least one flexible mandrel is attached to the bar stock for reducing distortion of the fabricated base, prior to the bending step. In an alternative embodiment, the cutting step occurs after the bending step.

It is therefore an aspect of the present invention to provide an economically viable stainless steel hatch base for use in commercial boat building.

It is another aspect of the present invention to provide a stainless steel hatch which includes a hatch base with a spigot which can be used with a standard trim ring.

It is still yet another aspect of the invention to provide a method for making a thin walled, continuous, integral stainless steel hatch base with a spigot.

These and other aspects, features, and advantages of the present invention will become readily apparent to those having ordinary skill in the art upon reading the following detailed description of the invention in view of the several drawings of the invention.

BRIEF DESCRIPTION OF THE DRAWINGS

The nature and mode of operation of the present invention will now be more fully described in the following detailed description of the invention in view of the accompanying drawing figures, in which.

DETAILED DESCRIPTION OF THE INVENTION

At the outset, it should be appreciated that while the present invention is described with respect to what is presently considered to be the preferred embodiments, the invention is not limited to the embodiments specifically recited herein. In the detailed description that follows like drawing numbers on different drawing views are intended to identify identical structural elements of the invention. Also, the adjectives, "front," "back," "left," "right," "top," and "bottom" and their derivatives, in the description herebelow, refer to the perspective of one facing the invention as it is shown in the Figure under discussion.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs.

Figure 1A:
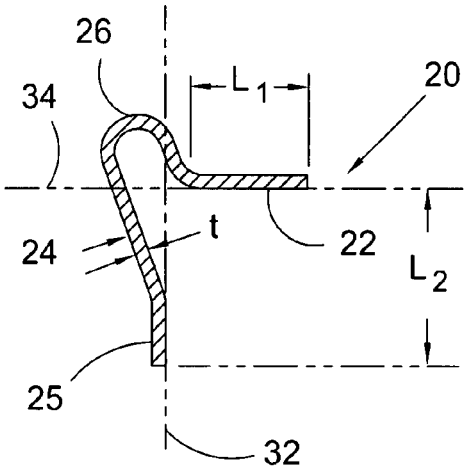
FIG. 1*a* is a cross-section of the hatch base taken generally along line 1*a*-1*a* in FIG. 1, with some components removed for clarity.
Figure 1:
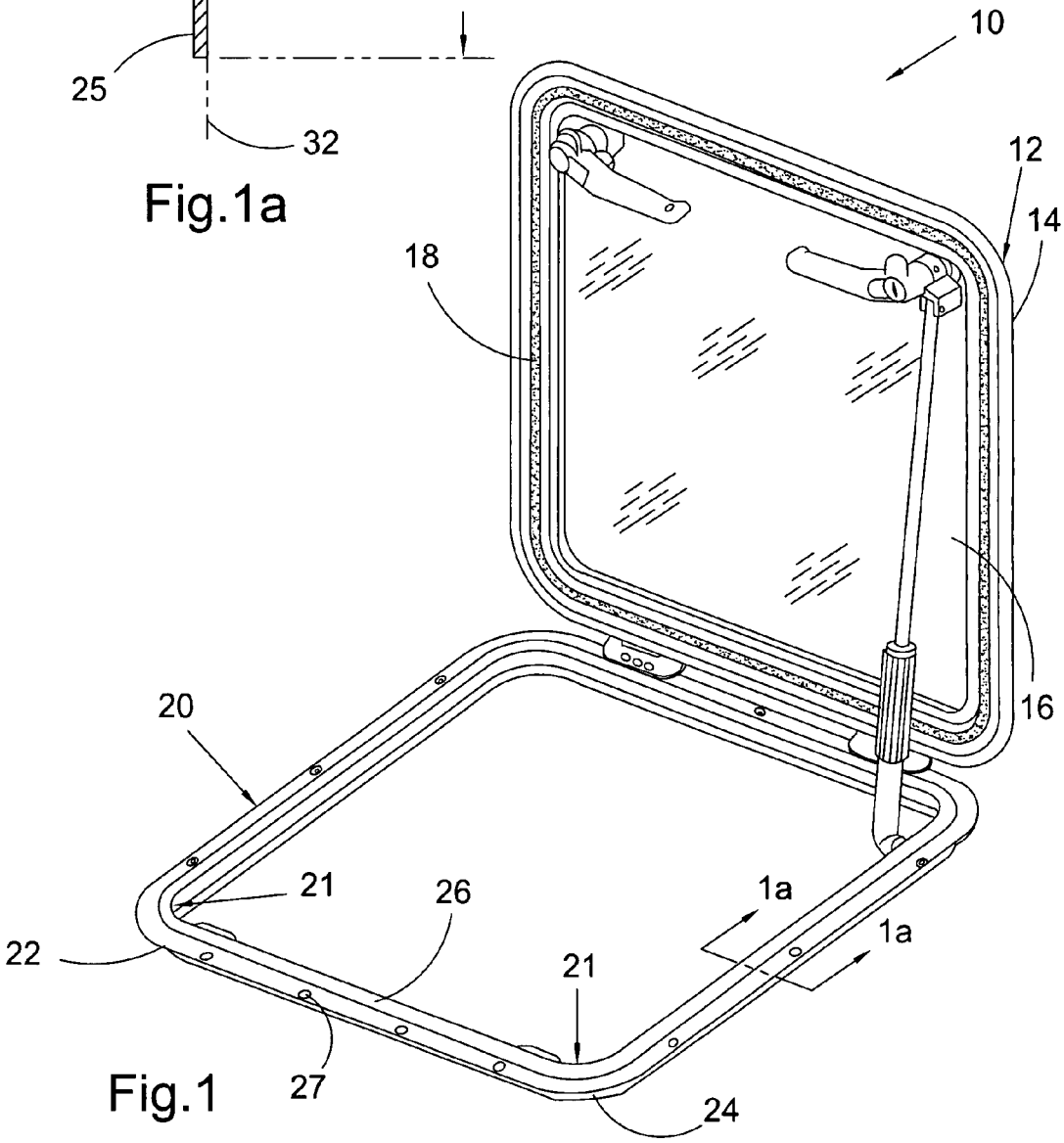
FIG. 1 is a perspective view of a hatch including a present invention hatch base.

Referring now to the figures, FIG. 1 is a perspective view of hatch 10. Hatch cover assembly 12 generally comprises hatch cover frame 14, lens 16, and hatch sealing gasket 18. It should be appreciated that this only describes a single embodiment of the hatch cover assembly, and that hatch cover assembly 12 could be any hatch cover assembly known in the art. Accordingly, hatch cover frame 14 could be formed from plastic, aluminum, stainless steel, or any other material known in the art. It should be appreciated that the hatch cover assembly is included as a typical hatch cover that may be used, and should not limit the scope of the current invention.

Hatch base 20 generally comprises an integral, one-piece ringed structure forming an opening which allows ingress and egress from one area of a boat to another. Hatch base 20 can be substantially any shape, including rectangular, trapezoidal, circular, or polygonal in general. It should be appreciated that since objects and people may pass through hatch base 20, sharp corners and edges are avoided. Therefore, in a preferred embodiment, hatch base 20 includes rounded corners 21. The rounded corners typically have relatively small radii. By relatively small radii, we mean that the corners generally outer radii with approximately four inches or less, and inner radii with approximately three inches or less. By outer radius we mean the radius of the outer most point of the exterior flange. By inner radius we mean the radius of the inner most point of the spigot. In the illustrated, preferred embodiment, the hatch base includes four rounded corners 21 which each have an inner radius of approximately 1¾ inches.

Hatch base 20 broadly comprises exterior flange 22, angular leg 24, and elevated sealing bead 26. In a preferred embodiment, the cross-section of hatch base 20 is substantially constant throughout, and the preferred cross-section is shown in FIG. 1*a*. In a preferred embodiment the exterior flange, angular leg, and elevated sealing bead all have a constant wall thickness t. In a preferred embodiment, thickness t is approximately 1/16" to 1/8". The following paragraphs will be discussed with respect to FIGS. 1 and 1*a*.

Exterior flange 22 runs in a plane parallel to the deck or hull of a boat in which hatch 10 is being installed. When installed, the exterior flange overlaps and lies flush against the deck or hull of the boat. In a preferred embodiment, exterior flange 22 includes through-bores 27 to receive screws or other fastening means (not shown). The through-bores may also be configured for securing to hatch cover assembly 12 by use of a hinge means. Flange length $L_1$, shown in FIG. 1*a*, should be long enough so that any securing means inserted into through-bores 27 are not too close to the edge of the hole cut out in the deck. It is known in the art that installing screws or other fastening means too close to the edge of a work piece, such as the deck or hull, could create cracks in the deck or hull. Length $L_1$ should also be sufficiently long to enable enough caulk or other adhesive sealant to be applied between the exterior flange and the boat deck or hull to create a water tight seal. In a preferred embodiment, length $L_1$ is approximately one inch or more.

Angular leg 24 generally comprises a portion of the hatch base that is received in the hole cut into deck of the boat when hatch base 20 is installed. Angular leg 24 is generally transverse to exterior flange 22. By generally transverse we mean that the angular leg is slightly angled away from being perpendicular to the exterior flange. It is clearly shown in FIG. 1*a* that angular leg 24 is generally transverse, but not exactly perpendicular to, flange 22. Angular leg 24 terminates in spigot 25. Unlike the rest of angular leg 24, spigot 25 is substantially perpendicular to exterior flange 22, for reasons which will be discussed infra. The spigot enables the determination of length $L_2$ which is measured perpendicularly from the bottom of the exterior flange, and therefore from dashed line 34, to the bottom of spigot 25.

Elevated bead 26 is operatively arranged for engaging with hatch sealing gasket 18. The elevated bead is substantially the rounded portion of the hatch which lies above dashed line 34 on FIG. 1*a*. Dashed line 34 is shown parallel to the bottom of exterior flange 22. In a preferred embodiment, elevated bead 26 is smooth and round so that people or objects passing through the hatch are not cut or damaged. Hatch sealing gasket 18 is generally included so that the hatch forms a water tight seal when the hatch is in a closed position. Hatch sealing gasket 18 is compressible, which enables the hatch sealing gasket to be compressed when the sealing gasket engages with elevated bead 26 of hatch base assembly 20 when hatch 10 is closed. Hatch sealing gasket can be formed from foamed rubber or other compressible material appropriate for forming a seal between the hatch cover assembly and hatch base assembly. Alternatively, the hatch sealing gasket could be replaced with any other sealing means known in the art for enabling a water tight seal between the cover and the base when the hatch is in a closed position.

Figure 2:
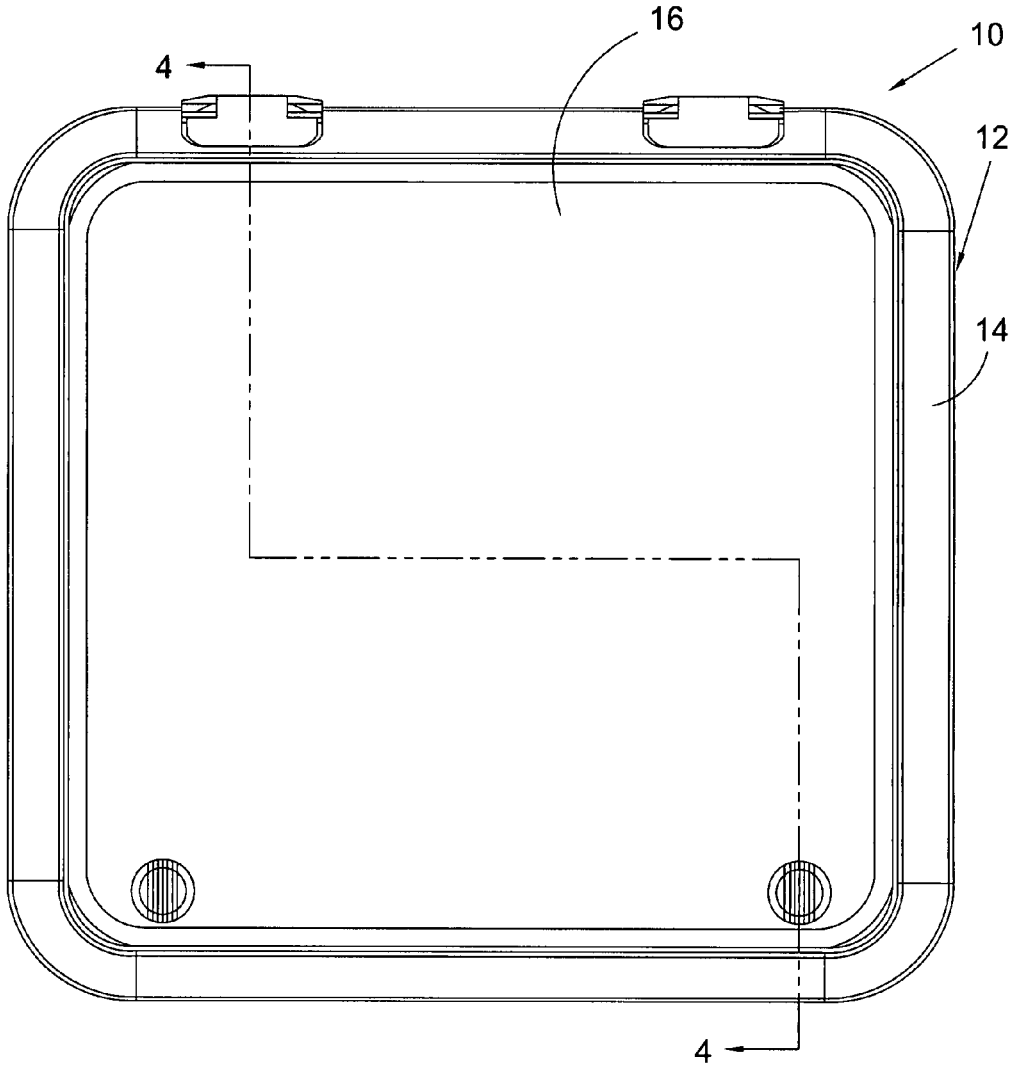
FIG. 2 is a top view of the hatch shown in FIG. 1.
Figure 3:
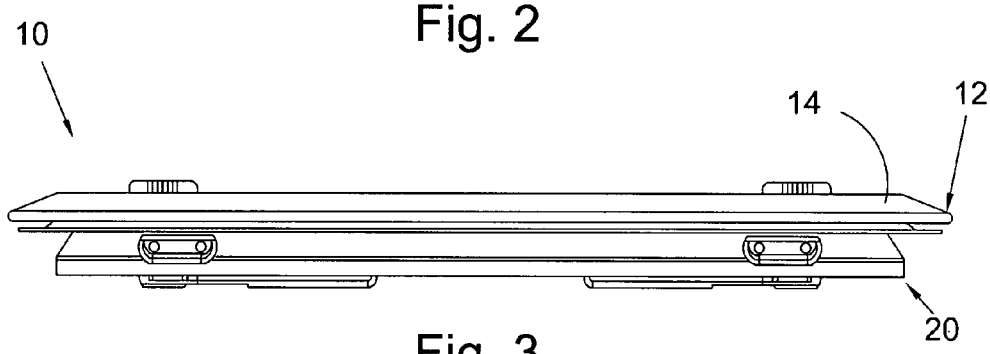
FIG. 3 is a front view of the hatch shown in FIG. 1.

FIGS. 2 and 3 show a top view and a front view of hatch 10 in a closed position, respectively. In the preferred embodiment shown, hatch cover assembly 12 is shown including hatch frame 14 and lens 16, and is attached above hatch base 20.

Figure 4:
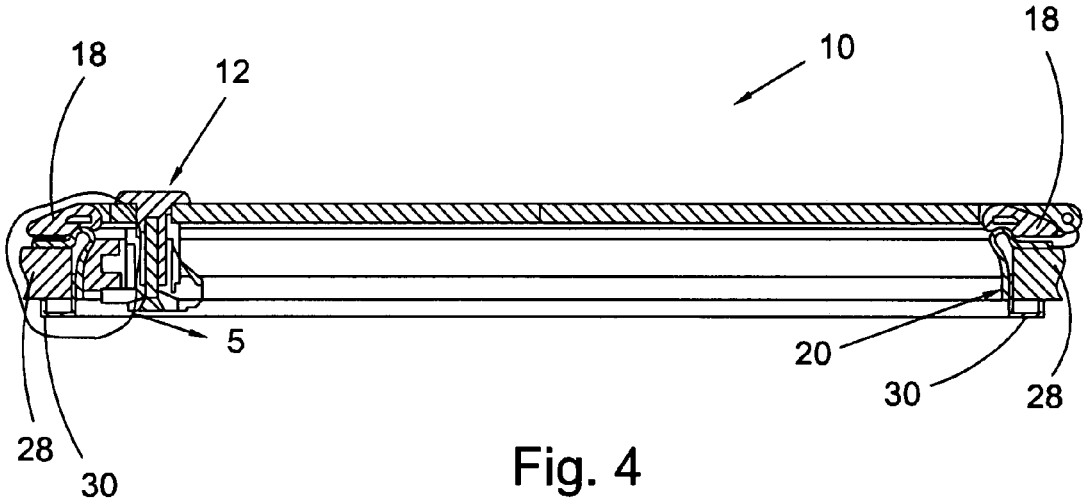
FIG. 4 is a cross-sectional view of the hatch taken generally along line 4-4 in FIG. 2, installed in a deck of a boat.

A cross-sectional view of hatch 10 taken generally along line 4-4 in FIG. 2 is shown in FIG. 4. Hatch 10 is shown installed in deck 28 of a boat. Additionally, trim ring 30 is installed on the bottom side of the deck, and is illustrated engaged between the edge of the hole cut in deck 28 and hatch base 20.

Figure 5:
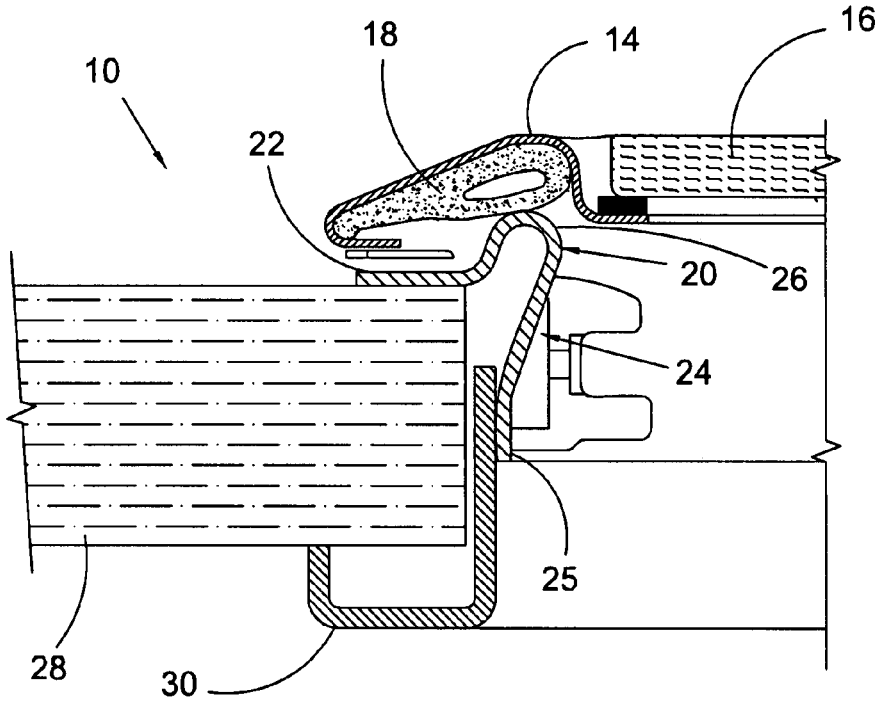
FIG. 5 is a partial cross-sectional view of the hatch shown in FIG. 4 installed in the deck of the boat.

FIG. 5 shows an enlarged view of the general area circled in FIG. 4. It is shown that exterior flange 22 overlaps deck 28, and that angular leg 24 extends into the hole in the deck, as discussed supra. The hatch cover assembly can also be seen including hatch frame 14 and lens 16. Hatch sealing gasket 18 is illustrated engaging with elevated bead 26 of hatch base 20. It is also shown that trim ring 30 engages between boat deck 28 and spigot 25. The mating of the trim ring and the hatch base is highly visible and critical due to aesthetics. It is paramount that the spigot is not warped or distorted so that the spigot can engage flush against the trim ring to provide the high level of aesthetics required in commercial boat building. In other words, the spigot is essential, and must be as perpendicular as possible to the deck and exterior flange (as vertical as possible in the shown embodiment), to ensure satisfactory mating of the trim ring and the spigot. In a preferred embodiment, length $L_2$ is approximately one inch or more for providing trim ring 30 a sufficient amount of the hatch base with which to engage.

It should be appreciated that the amount of flaring is primarily dependent on length $L_2$ and the distance between the neutral axis and the spigot. The flaring increases as either length $L_2$ increases, or the spigot is positioned farther from the neutral axis. The longer length $L_2$, the more easily flaring can be recognized, as the distortion due to flaring is compounded and magnified down the length of the angular leg and spigot. It should also be appreciated that the determination of unacceptable flaring is largely subjective, and is judged chiefly by visual examination. Accordingly, if there were two substantially identical bases, but with one having length $L_2$ twice that of the other, which have been bent by substantially identical processes to form substantially identical corners, then because of the amplification of the flaring down lengths $L_2$, the base with the shorter length may look acceptable, while the base with the longer length may not. Lastly, it should be appreciated that there should be virtually no flaring if the spigot is positioned properly with respect to the neutral axis, regardless of length $L_2$.

Referring back to FIG. 1*a*, neutral axis 32 is shown lying substantially parallel to and proximate the spigot. As is well known in the art, during bending the material on the inside of the bend undergoes compression, while the material on the outside of the bend undergoes tension. The neutral axis represents the theoretical plane which lies directly at the border of compression and tension, and material which lies on the neutral axis ideally experiences neither tension nor compression. For example, when corners 21 are bent, all material on the exterior side (mainly exterior flange 22 in the shown embodiment) is in tension while the material on the inside of the corner (mainly angular leg 24 and elevated bead 26 in the shown embodiment) is in compression. In traditional hatch bases the spigot would undergo a lot of compression, and therefore experience substantial flaring. Material close to the neutral axis undergoes substantially less compression or tension, and consequently exhibits less flaring. The neutral axis is dependent upon the cross-section of the piece to be bent, with relation to the direction in which the piece is being bent. The relevant cross-section, shown in FIG. 1*a*, has neutral axis 32 positioned proximate the spigot.

The position of the neutral axis is critical in fabricating a functionally and visually acceptable hatch base. The spigot is positioned so that it lies substantially along the neutral axis. The spigot may lie approximately within a distance equal to one wall thickness t away from the neutral axis and still experience an acceptable amount of flaring. If the spigot is not proximate or within a distance of approximately one wall thickness from the neutral axis, the flaring that occurs will render the spigot unable to properly mate with the trim ring. Therefore, the current invention hatch base positions the spigot appropriately so that the spigot will not experience substantial flaring and will be acceptable for use with a trim ring.

In a preferred embodiment a stainless steel hatch gets its cross-sectional profile, such as is shown in FIG. 1*a*, by roll-forming. In roll-forming a work piece typically originates as coiled sheet stock. The coiled sheet stock is fed through a plurality of rollers sets. The rollers comprise at least two oppositely disposed rollers which form a slot between them. The shape of the slot is determined by the contours and spacing of the rollers in any particular set. The work piece consequently bends to take the form of the slot as the work piece is forced or fed through the slot. Typically each roller set incrementally bends the work piece until the desired cross-section is achieved. To obtain the cross-section shown in FIG. 1*a*, the work piece would have to theoretically pass through at least three roller sets: a first roller set to form elevated sealing bead 26; a second roller set to bend exterior flange 22 into a horizontal position; and a third roller set to bend spigot 25. In actual practice, however, the number of roller sets could be as high as fifteen sets or more, as each bend would like occur incrementally over several roller sets. It should be appreciated that only the final cross-section is important, and not the exact number of roller sets. It should also be appreciated that it is not important which order the elements are bent into the cross-section (such as the exterior flange, spigot, and elevated bead, as illustrated). Therefore, it should be appreciated that several different configurations of roller sets are possible to produce the desired cross-section, and the current invention should not be limited to any one roll-forming configuration.

After roll-forming, the work piece is essentially a straight length of bar stock with the desired cross-section. Therefore the hatch base must be bent to form its final shape, which could be polygonal or circular. As discussed supra, the cross-section of the hatch base must position the spigot proximate or along the neutral axis to avoid unacceptable flaring. Any bending technique known in the art could be used, but in a preferred embodiment the hatch base is bent by rotary bending. In rotary bending a plurality of dies are positioned about the work piece to be bent. At least two dies are operatively arranged to clamp a portion of the work piece in a stationary position. The die positioned on the inside of the bend is contoured so that as the work piece is bent, the work piece will wrap around that die, forming a rounded corner of a radius dictated by the contour of the die. At least two other mobile dies guide the work piece as it is bent around the stationary, contoured die. The work piece is readjusted to clamp a different portion of the work piece, and the bending process is repeated to form as many corners as necessary.

Before, after, or during the bending process, the work piece must be cut so that it is the proper length for creating the finished hatch base. The proper length can be determined by calculations, experimentation, or a combination of both. After the work piece is bent and cut, the two opposite ends are welded together so that the hatch base is a single, continuous, integral piece. It should be appreciated that additional treatments, such as grinding off the weld bead, polishing the hatch base, or the like, may also be performed.

It should be appreciated that in bending traditional hatch bases, flexible mandrels are commonly attached to the part being bent to help physically restrict the movement of material in an effort to avoid flaring. Without these mandrels flaring, warping, crumpling, or distortion is extremely likely to occur. In the current invention hatch base however, the positioning of the spigot proximate the neutral axis enables bending to be done without the use of mandrels. Advantageously, eliminating the need for mandrels saves both time and material.

Thus, it is seen that the aspects of the present invention are efficiently obtained, although modifications and changes to the invention should be readily apparent to those having ordinary skill in the art, which modifications are intended to be within the spirit and scope of the invention as claimed.

What is claimed is:

1. A base for a marine hatch comprising:

(i) a planar exterior flange running in a plane substantially parallel with a boat hull or deck;

(ii) an angular leg running generally transverse to said planar exterior flange;

(iii) said angular leg terminating in a spigot, wherein said spigot is substantially perpendicular to said exterior planar flange, said spigot is operatively positioned so that said spigot runs substantially parallel to a neutral bending axis, and said neutral bending axis passes through or is directly proximate said spigot; and (iv) an elevated sealing bead for engaging with a hatch cover, said planar exterior flange and said angular leg being integral with said elevated sealing bead;

(v) wherein said base is fabricated from stainless steel.

2. The base recited in claim 1, wherein a length perpendicularly measured from a bottom of said exterior flange to a bottom of said spigot is approximately one inch or more.

3. The base recited in claim 1, wherein a wall thickness of said base is substantially constant throughout said base.

4. The base recited in claim 1, wherein a wall thickness of said base is approximately 1/16" to 1/8".

5. The base recited in claim 1, wherein said exterior flange includes a plurality of apertures operatively arranged for receiving securing means for affixing said hatch frame to a deck or hull of a boat.

6. The base recited in claim 1, wherein said planar exterior flange has a length of approximately one inch or more.

7. The base recited in claim 1, further including a plurality of rounded corners for forming said base into a shape.

8. The base recited in claim 7, wherein said rounded corners have outer radii of approximately four inches or less.

9. A marine hatch comprising the base according to claim 1.

10. The marine hatch recited in claim 9, further comprising:

a hatch cover;

means for sealing said marine hatch when said hatch cover is closed; and wherein said sealing bead engages with said means for sealing said marine hatch when said hatch cover is closed.

11. The marine hatch recited in claim 9, further comprising a trim ring operatively arranged to slip between said spigot of said hatch base and said boat hull or deck.

12. A process of making a stainless steel hatch base comprising the steps of:

(a) forming a straight length of a stainless steel bar stock with a substantially constant cross-section by passing a stainless steel work piece originally in the form of coiled stainless steel sheet stock, through a plurality of roll-forming roller sets, wherein each roller set includes at least two oppositely disposed rollers which form a slot through which said work piece is rolled, wherein each slot is operatively arranged to bend said work piece as said work piece passes through each roller set, wherein said work piece passes sequentially, in any order, through each roller set in said plurality of roller sets, wherein said plurality of roller sets comprises at least first, second, and third roller sets, wherein said first roller set bends a substantially hairpin bend into said work piece to form an elevated bead, said second roller set bends said work piece to form a planar exterior flange, said third roller set bends said work piece to form an angular leg terminating in a spigot, wherein said angular leg runs in a plane generally transverse to said planar exterior flange, and wherein said spigot runs in a plane substantially perpendicular to said planar exterior flange;

(b) cutting said work piece to a predetermined length based on a desired final size of said hatch base;

(c) bending a plurality of corners into said length of said work piece, wherein said corners are operatively bent into said work piece to substantially shape said work piece into a substantially ring shape with opposite ends of said work piece proximate each other, and wherein said bending is operatively performed so that said spigot is substantially parallel to a neutral axis of said bending, and said neutral axis passes through or is directly proximate said spigot; and, (d) welding said opposite ends together so that said hatch base is an integral, continuous piece.

13. The process recited in claim 12, wherein a length perpendicularly measured from a bottom of said exterior flange to a bottom of said spigot is approximately one inch or more.

14. The process recited in claim 12, wherein said spigot does not exhibit an unacceptable amount of flaring during bending step (c), and therefore does not require the use of a flexible mandrel.

15. The process recited in claim 12, wherein cutting step (b) occurs after bending step (c).

16. The process recited in claim 12, wherein said corners have outer radii of approximately four inches or smaller.

17. The process recited in claim 12, wherein said hatch base is substantially polygonal in shape.

18. The process recited in claim 12, wherein said corners are operatively arranged for forming said base into a substantially circular shape.

19. A hatch base made according to the process of claim 12.

20. A base for a marine hatch comprising:

(i) a planar exterior flange running in a plane substantially parallel with a boat hull or deck;

(ii) an angular leg running generally transverse to said planar exterior flange;

(iii) said angular leg terminates in a spigot, wherein said spigot is substantially perpendicular to said exterior planar flange, said spigot is operatively positioned so that said spigot runs substantially parallel to a neutral bending axis, and said neutral bending axis passes through or is directly proximate said spigot;

(iv) an elevated sealing bead for engaging with a hatch cover, said planar exterior flange and said angular leg being integral with said elevated sealing bead;

(v) a plurality of rounded corners forming a shape of said base, wherein outer radii of said rounded corners are approximately four inches or smaller; and, (vi) wherein said base is a single, continuous piece fabricated from stainless steel, said base having a constant wall thickness throughout, wherein said wall thickness is approximately 1/16" to 1/8".

21. The base recited in claim 20, wherein said shape of said base is substantially circular.

22. The base recited in claim 20, wherein said shape of said base is substantially polygonal.

23. The base recited in claim 20, wherein a length perpendicularly measured from a bottom of said exterior flange to a bottom of said spigot is approximately one inch or more.

* * * * *